United States Patent [19]

King et al.

[11] 4,435,862

[45] Mar. 13, 1984

[54] CONTROL ARRANGEMENT AND METHOD FOR AN ADJUSTABLE BED

[75] Inventors: Frank R. King, Glen Mills; Donald J. Engler, Upland, both of Pa.

[73] Assignee: Simmons Universal Corporation, New York, N.Y.

[21] Appl. No.: 312,528

[22] Filed: Oct. 19, 1981

[51] Int. Cl.[3] ..... A61G 7/06

[52] U.S. Cl. ..... 5/66; 5/60; 318/467; 318/568

[58] Field of Search ..... 5/60, 66–69; 318/568, 569, 467; 340/825.19, 825.22, 825.5, 825.31; 364/153, 171, 188, 190

[56] References Cited

U.S. PATENT DOCUMENTS

| | | | |
|---|---|---|---|
| 3,710,404 | 1/1973 | Peterson | 5/68 |
| 3,839,753 | 10/1974 | Benoit et al. | 5/68 |
| 3,876,885 | 4/1975 | Catterall | 340/825.5 |
| 3,913,153 | 10/1975 | Adams et al. | 5/68 |
| 3,938,016 | 2/1976 | Lange et al. | 318/467 |
| 4,062,075 | 12/1977 | Stern et al. | 5/68 |
| 4,094,024 | 6/1978 | Benoit et al. | 5/68 |
| 4,242,621 | 12/1980 | Spaulding | 318/569 |
| 4,368,412 | 1/1983 | Inoue | 318/568 |

OTHER PUBLICATIONS

Donald G. White, "A Basic Distributed Micro-Computer Control System", Jul. 1977, Solid State Technology, vol. 20, No. 7, pp. 38–42.

*Primary Examiner*—Alexander Grosz
*Assistant Examiner*—Michael F. Trettel
*Attorney, Agent, or Firm*—Bell, Seltzer, Park & Gibson

[57] ABSTRACT

A control arrangement and method for a motor driven adjustable bed which has mattress supporting portions, a frame for supporting the mattress supporting portions, and a position controlling mechanism operatively interconnecting the mattress supporting portions and the frame and including a plurality of motors. In accordance with the present invention, an operator of the bed may generate command signals indicative of selected bed positions and a processor responsive to command signals and to control signals stored in a programmable memory actuates at least one of the motors for moving the frame toward an allowed, selected bed position. In accordance with the present invention, the motors may be actuated in selected combinations and sequences so as to achieve particular bed positions as described more fully in the accompanying description.

15 Claims, 20 Drawing Figures

CONTROL ARRANGEMENT AND METHOD FOR AN ADJUSTABLE BED

FIELD AND BACKGROUND OF INVENTION

This invention relates to control arrangements for an adjustable bed and, more particularly, to a microprocessor control for motor means actuating the position controlling mechanism of such a bed which facilitates movement of the bed into a variety of positions.

Adjustable beds are widely used in hospitals and the like in order to accommodate positioning of an occupant of a bed in a variety of positions. Heretofore, adjustable beds have provided either for manual adjustment of the position of elements of the bed or for motor controlled positioning of elements of the bed. The present invention is particularly concerned with motor controlled adjustable beds, in which the positioning of elements of the bed is controlled by actuation of motors such as electrical motors.

Previously known motor controlled adjustable beds have been able to attain a variety of positions for an occupant of the bed, oftentimes by controlling the simultaneous or sequential actuation of a plurality of motors. However, the manner in which control over such actuation of motors and movement of the elements of the bed occurs is somewhat restricted with respect to the range of positions attainable and the flexibility of control functions.

BRIEF DESCRIPTION OF INVENTION

With the foregoing discussion in mind, it is an object of the present invention to efficiently and effectively accommodate movement of a motor controlled adjustable bed into a variety of positions. In realizing this object of the present invention, the use of a programmable memory facilitates storage and retrieval of instructions concerning the coordination and sequence of actuation of motors controlling the movement of elements of an adjustable bed. By the use of a programmable memory, the control is readily adaptable to any desired range of positions of which an adjustable bed may be capable. Further, the control is readily adaptable to beds of varying construction and sophistication.

Yet a further object of the present invention is to control the operation of an adjustable bed in accordance with a method by which instructions concerning positioning of elements of the bed and sequences of motor operation necessary to achieve such positioning are stored in a programmable memory from which the instructions are retrieved, by appropriate input signals, by a microprocessor. Such methods of control are essentially digital, digitally directed, and are compatible with conventional computer control methods. As a result, adaptation of an adjustable bed controlled in accordance with the methods of the present invention to varying circumstances of use is more readily made possible.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

While the present invention will be described more fully hereinafter with references to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Referring now more particularly to the accompanying drawings, an adjustable bed embodying the control arrangements and methods of the present invention is there shown and generally indicated at 10. In order to provide a more readily understandable background for the specific description of the control arrangements and methods of the present invention which will follow hereinafter, it is first appropriate to consider the construction and arrangement of the elements of the adjustable bed 10. However, it is to be recognized that the control arrangement and method to be described is adaptable to adjustable beds of other types not here illustrated or described. Persons of ordinary skill in the arts of designing adjustable beds may identify previously granted patents including disclosures of such beds.

Figure 1:
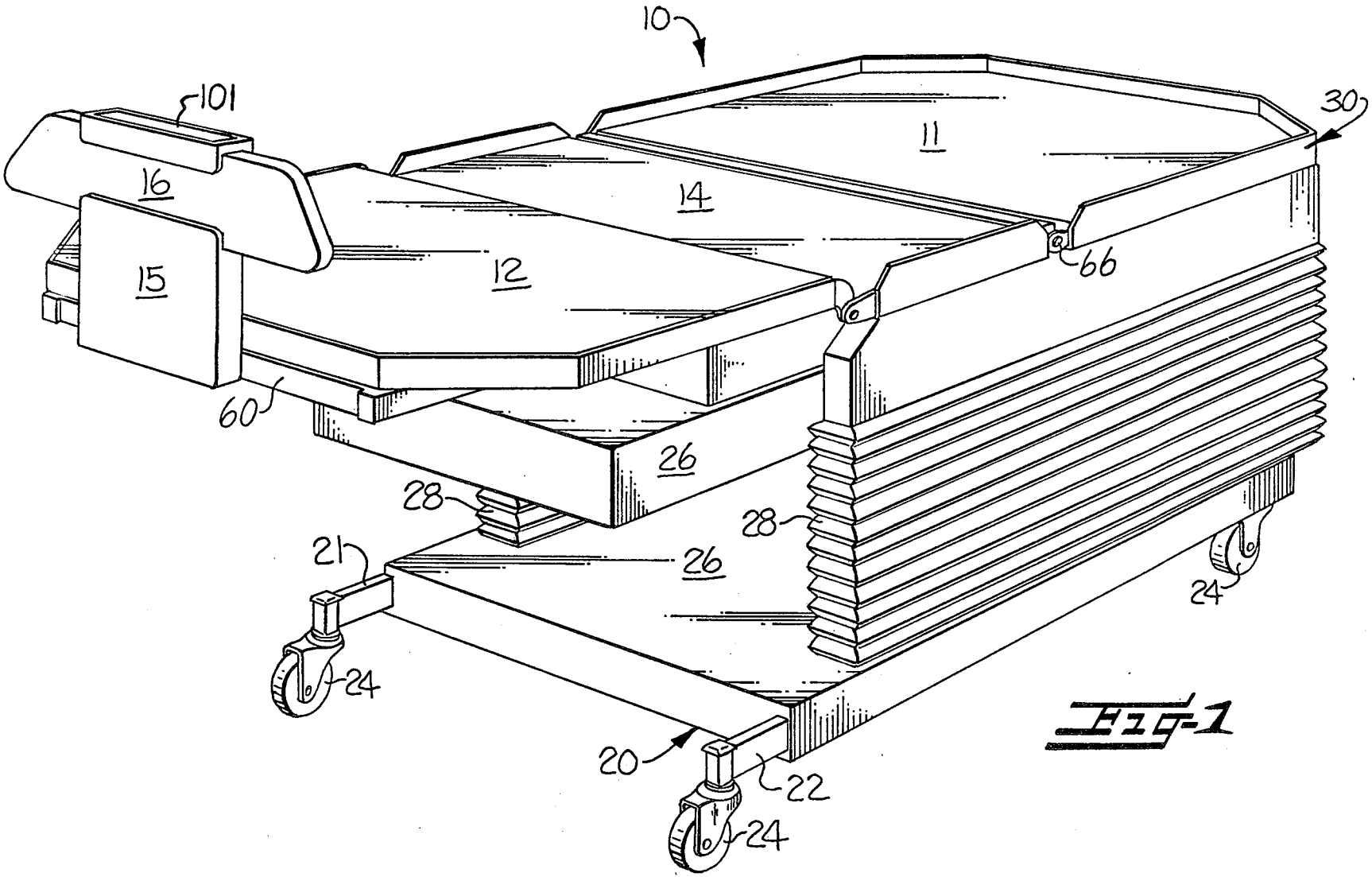
FIG. 1 is a perspective view of an adjustable bed embodying the present invention.
Figure 2:
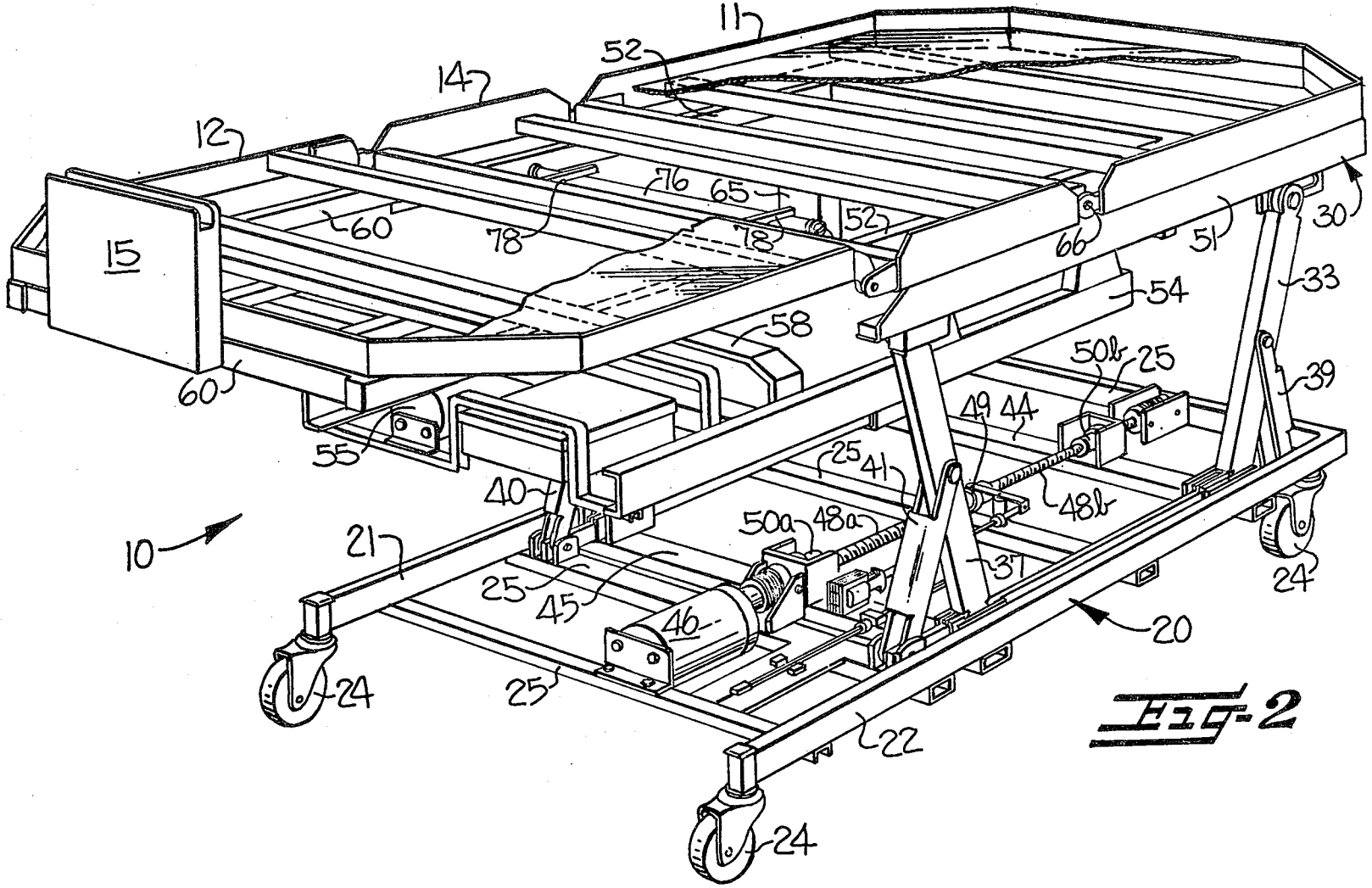
FIG. 2 is a view similar to FIG. 1, showing components of the bed of FIG. 1 with covers removed.
Figure 3:
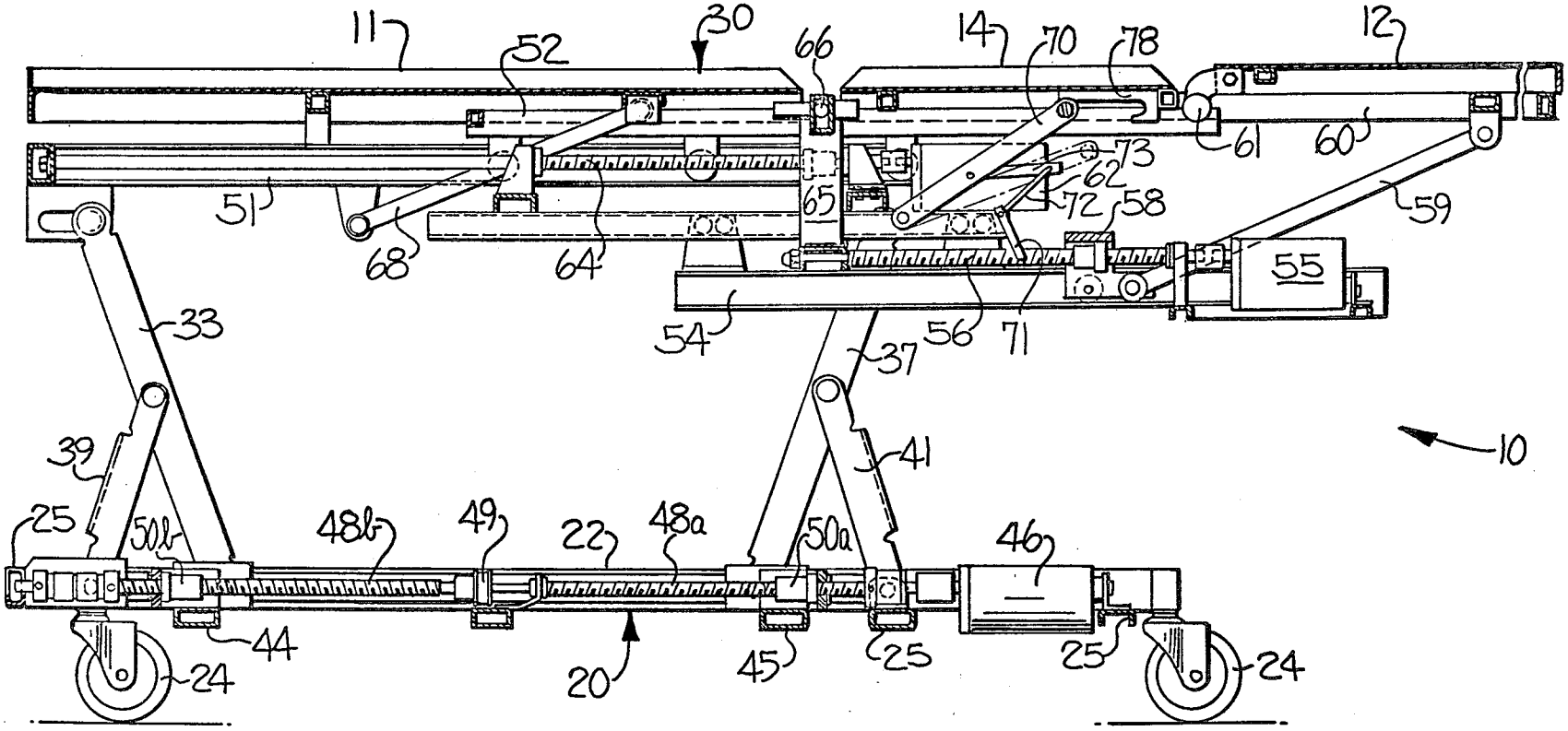
FIG. 3 is a side elevation view, partly in section, through the bed of FIGS. 1 and 2.
Figure 18:
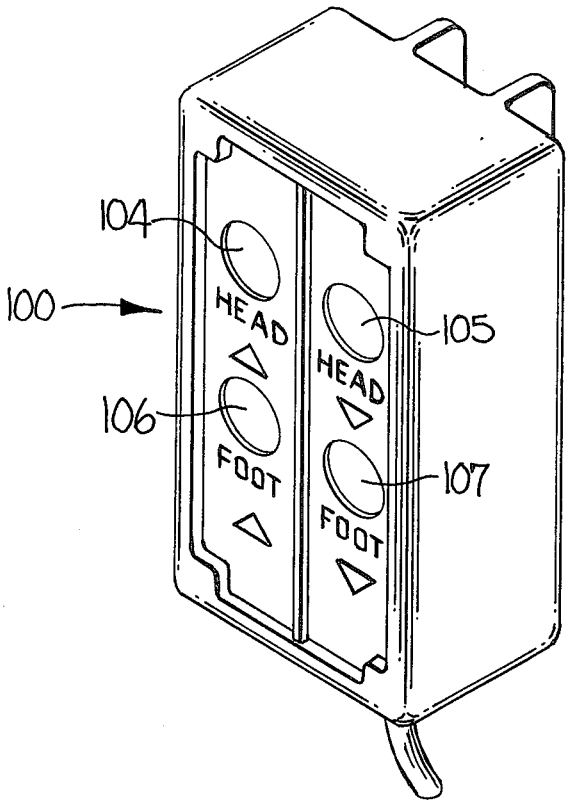
FIG. 18 is a somewhat schematic view of an occupant or patient control station.
Figure 19:
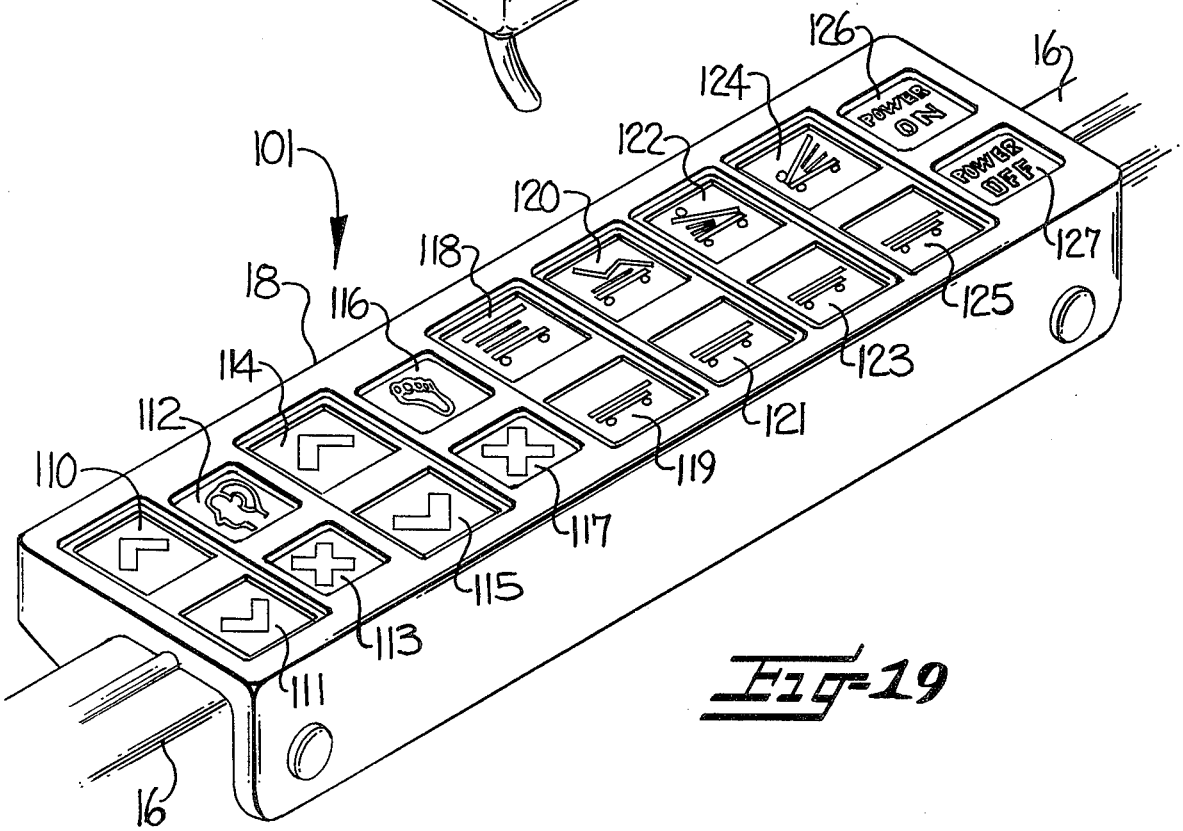
FIG. 19 is a somewhat schematic view of an attendant or nurse control station.
Figure 20:
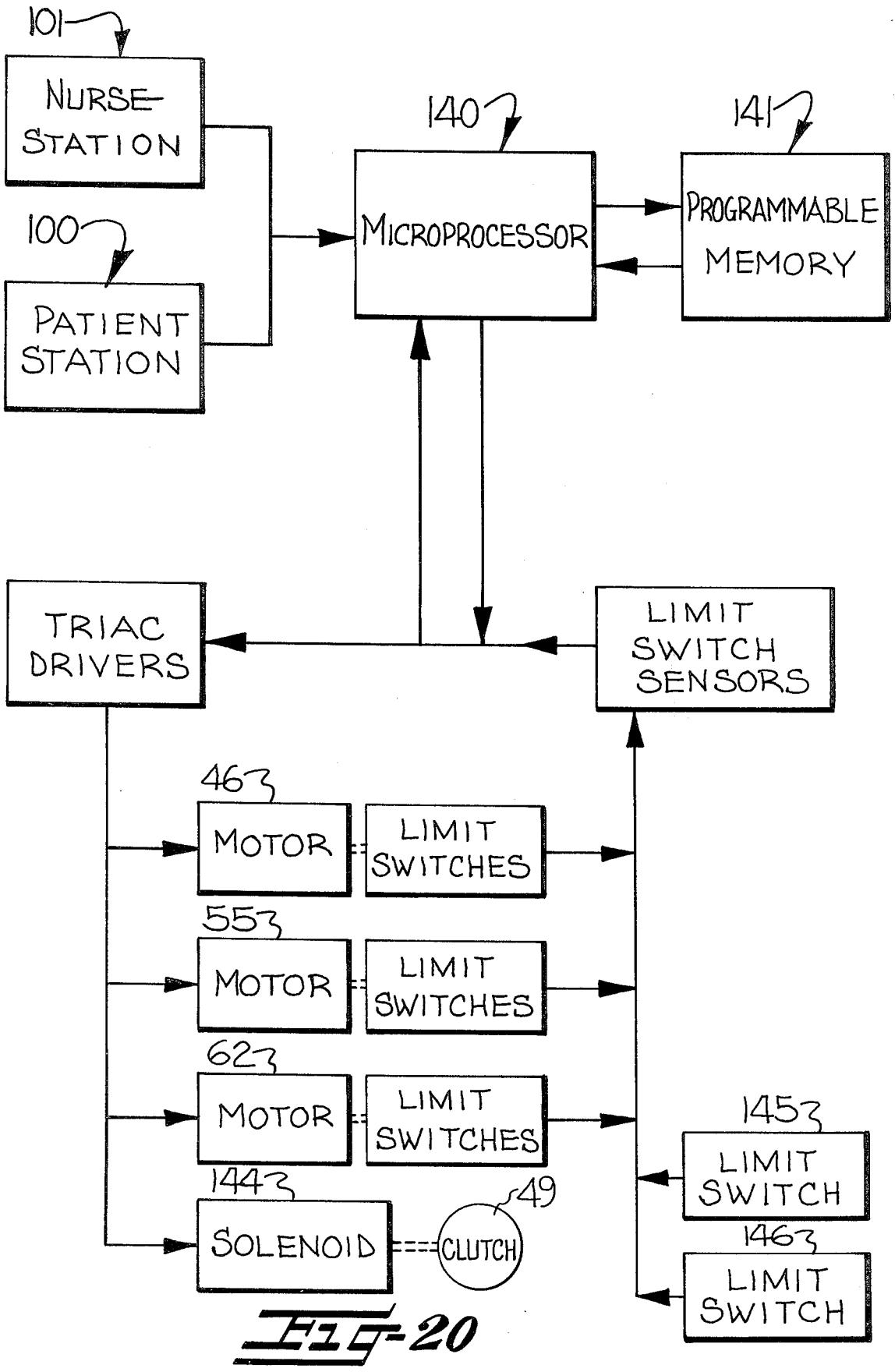
FIG. 20 is a schematic, block diagram representation of the control arrangement of this invention.

The bed 10 which has been illustrated includes mattress supporting portions, which may be referred to as a mattress platform or as mattress pans, and which include a head portion 11 at a head end of the bed, a foot portion 12 at a foot end of the bed, and a thigh portion 14 between the head and the foot portions. Adjacent the foot end of the bed 10 is a foot board support 15 and a foot board 16 on which a control console 101 (FIGS. 1 and 19) is mounted. An occupant control console 100 (FIG. 18) is mounted in a suitable position adjacent the side of the bed, such as a side rail not shown, and within easy reach of the occupant of the bed.

A base frame means, generally indicated at 20, is provided for supporting the mattress supporting portions 11, 12, 14. The base frame means 20 includes main longitudinal fore and aft or head-to-foot frame members 21, 22 having at respective head and foot ends thereof casters 24 for engaging the floor. Cross tubes 25 extend between the lengthwise members of the base frame means 20 in order to provide structural integrity.

As will become more clear from the discussion which follows, the mattress supporting portions 11, 12, 14 are operatively interconnected with the base frame means 20 by position controlling mechanism. Stated broadly, the position controlling mechanism comprises upper frame means having a head end and a foot end and operatively connected with the mattress supporting portions for moving the mattress supporting portions relative to one another, lifting arm means operatively connecting the upper frame means with the base frame means 20 for moving the head and foot ends of the upper frame means vertically relative to the base frame means 20, and motor means operatively connected with the upper frame means and with the lifting arm means for moving the upper frame means and the lifting arm means and thereby for positioning the mattress supporting portions 11, 12, 14 in a desired position. Preferably, and as described more fully hereinafter, the motor means takes the form of electrical motors controlled by operation of the control arrangement of this invention.

The upper frame means includes a lifting frame structure and a sliding frame structure which is suspended from, and movable relative to, the lifting frame as brought out more fully hereinafter. The upper frame means is operatively connected with the base frame means 20 by a pair of head end lift arms 32, 33 and a pair of foot end lift arms 36, 37. Each lift arm is pivotally connected with the lifting frame at the upper end thereof by a suitable pivot pin. Pivotally connected to each lift arm 32, 33, 36, 37, intermediate the length thereof, is corresponding stabilizing arm 38, 39, 40, 41. The lower end of each stabilizing arm is pivotally connected to the base frame means 20.

The lower end of each lifting arm 32, 33, 36, 37 is pivotally connected to a corresponding one of a head end subframe 44 and a foot end subframe 45. The head end subframe and foot end subframe are mounted on the base frame means 20 for movement therealong. Movement of the lifting arms 32, 33, 36, 37 is under the control of a lifting drive motor means 46 which, through a suitable reduction gearing, drives a lifting ball screw which is divided between a foot end portion **48*a* and a head end portion 48*b*. The ball screw portions 48*a*, 48*b* are joined by means of a clutch mechanism generally indicated at 49 and which is operative as described more fully hereinafter to control operation of the bed 10. Each of the ball screws is engaged by a corresponding ball nut 50*a*, 50*b* fixed to a corresponding subframe 45, 44. Upon rotation of the ball screws 48*a*, 48*b* as driven by the lifting motor means 46, one or both of the subframes 44, 45** is moved so as to move the corresponding lifting arms.

The ball screws **48*a*, 48*b* are of opposite hand. As a consequence, where the clutch 49 is actuated so as to couple the ball screws together for rotation at the same time and in a common rotational direction, the ball nuts 50*a*, 50*b* are moved toward one another or away from one another with a coordinated movement. That is, with rotation of the ball screws 48*a*, 48*b* in a first direction, while the clutch couples the two together, the ball nuts 50*a*, 50*b* are drawn toward one another. As a consequence, the upper frame means of the bed 10 is lowered while being maintained in a predetermined orientation, such as being horizontal. With rotation of both ball screws 48*a*, 48*b* in the opposite direction, the ball nuts 50*a*, 50*b*** are moved apart.

Selective actuation of the clutch means 49 will permit movement of the upper frame means into other orientations. For example, assuming that the mattress supporting portions 11, 12, 14 are arranged in co-planar generally horizontal array, movement of the foot end ball nut **50*a* may accomplish positioning of the adjustable bed 10 in a selected one of the positions known as Trendelenburg and reverse Trendelenburg. In Trendelenburg or shock position, the foot of the bed is elevated over the head. In reverse Trendelenburg or drain position, the head of the bed is elevated over the foot. In order to reach the Trendelenburg position, the bed may be lowered to the lowermost position and, upon actuating the lifting drive motor 46, the clutch 49 may be operated to disengage the ball screws 48*a*, 48*b*. As a consequence, only the foot end ball screw 48*a* would be driven in rotation, permitting movement of the foot end lifting arms 36, 37 so as to raise the foot end of the bed. Should it be desired to attain a reverse Trendelenburg position, the bed may be moved to its maximum elevated position thereafter, upon actuation of the lifting drive motor 46, with the clutch 49 disengaged, the foot end ball screw 48*a* may be driven in such a manner as to lower the foot end of the bed and achieve the reverse Trendelenburg position. As will be clear, actuation of the lifting motor 46 with the clutch 49** engaged will lower and raise the bed while maintaining the particular angular attitude to which the upper frame means and the mattress supporting portions have been moved.

The mattress supporting portions 11, 12, 14 are constructed of peripheral frames having cross members and are operatively supported on and by, and connected with, a number of components of the upper frame means 30. The upper frame means 30 includes a component which essentially maintains a single head-to-foot orientation and position with respect to the base frame and is thus referred to as a stationary upper frame element 51. The stationary upper frame element 51 provides a connection point for the lift arms 32, 33, 36, 37. Additionally, the stationary upper frame 51 provides support for an upper sliding frame 52, a lower sliding frame or intermediate frame 54, and certain other components as will be described more fully hereinafter.

Mounted on the lower moving frame or intermediate frame 54 is a foot drop drive motor 55 which drives a foot drop screw 56. By means of a foot drop yoke assembly 58 engaging the foot drop screw 56 and a foot drop arm 59 coupled to the yoke assembly 58, a swing frame 60 which forms a portion of the upper moving frame 52 may be pivoted about a pivot location defined by a pivot pin 61. The swing frame 60 underlies the foot wing or foot portion 12 of the mattress supporting portions of the bed 10 and, on being moved by operation of the foot drop motor 55, positions the foot end portion 12 at a desired position. As will be pointed out more fully hereinafter, the cooperation of these elements of the bed of the present invention with other elements yet to be described permits achieving bed positions approximating those of a chair, in order that a patient may essentially be seated upright.

Figure 4:
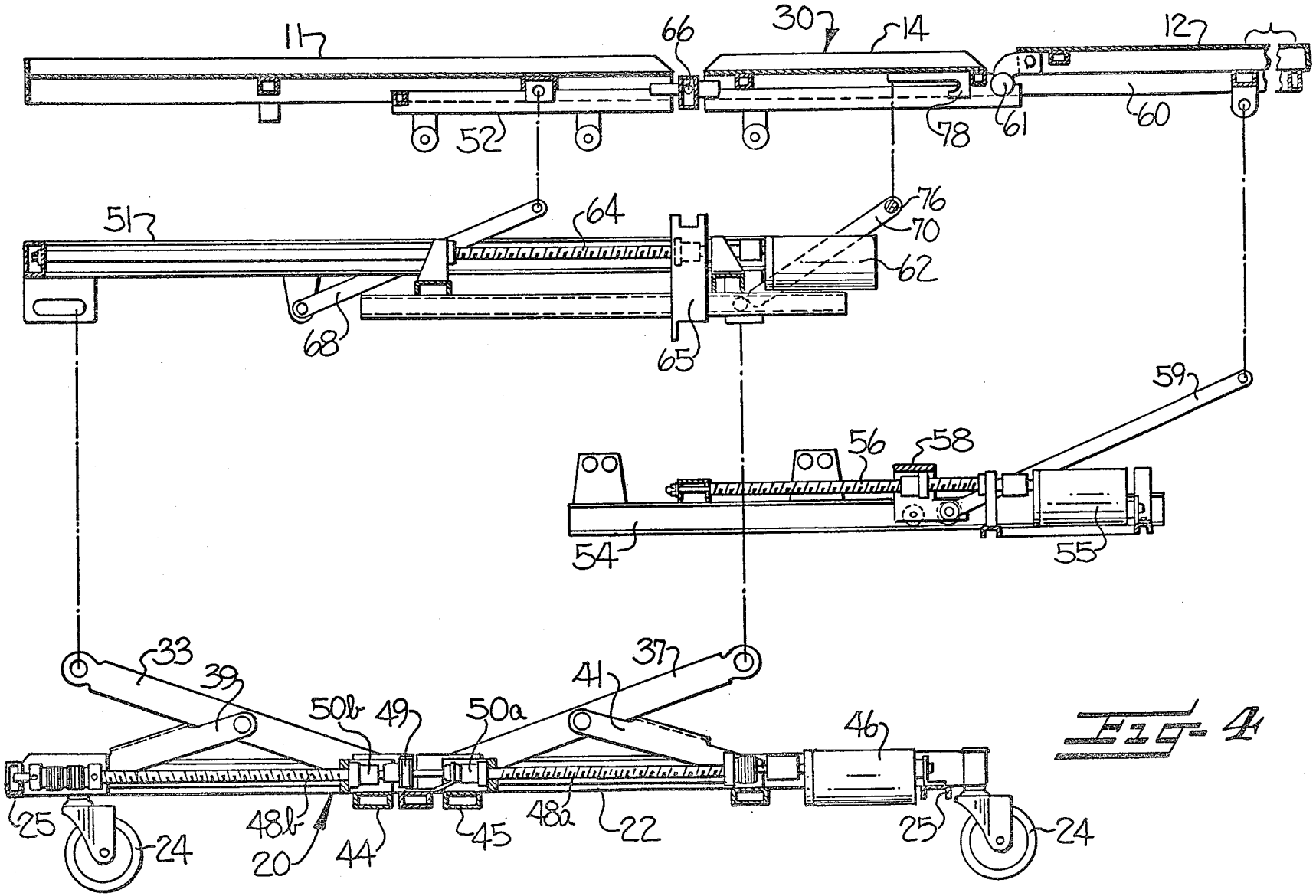
FIG. 4 is an exploded view similar to FIG. 3, illustrating certain of the components of the bed of FIGS. 1–3.

Mounted on the stationary upper frame is a head lift drive motor 62 which drives a head lift screw 64. The head lift screw 64 is engaged by a drive nut mounted in a support member 65 which engages a number of components of the bed 10 of the present invention. First, the support member 65 is coupled, through a pivot pin 66, to a joint between the head end mattress supporting portion 11 and the thigh portion 14. Further, at its lower end, the support member 65 engages the moving intermediate frame 54. Finally, the support member 65 is coupled to the moving upper frame 52. As a consequence, when the head lift motor 62 is operated to rotate the head lift drive screw 64 in one particular direction, the support member 65 moves (to the left in FIGS. 4 and 5) in such a direction as to move the mattress supporting portions 11, 12, 14, the upper moving frame 52, and the intermediate moving frame 54 all in a common direction. As such movement occurs, a head wing lift arm 68 which extends between the head portion 11 and the stationary upper frame 51 causes the head wing portion 11 to be pivoted upwardly about the pivot point 66 mentioned earlier.

Figure 5:
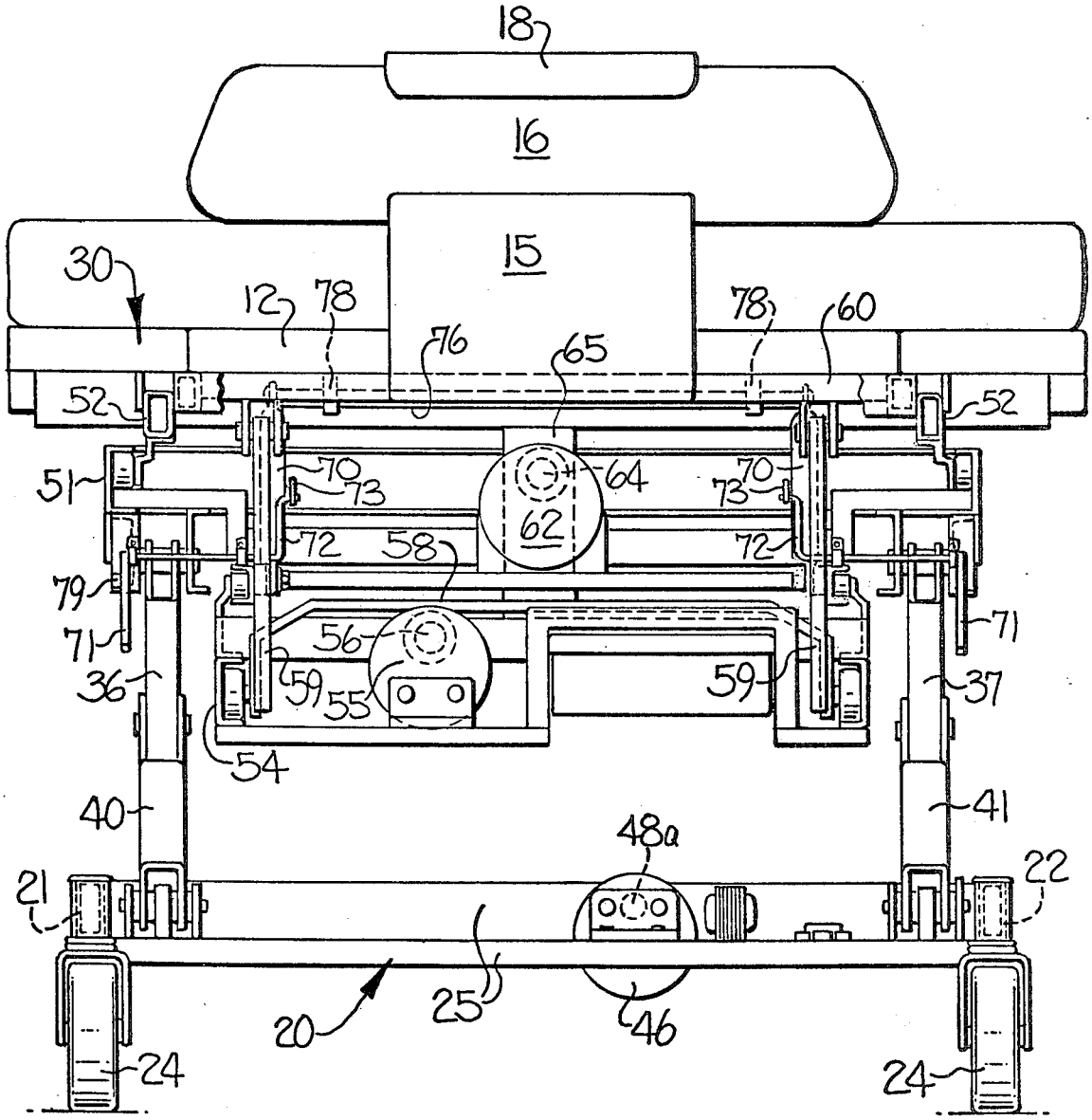
FIG. 5 is an end elevation view of the bed of FIG. 2.
Figure 6:
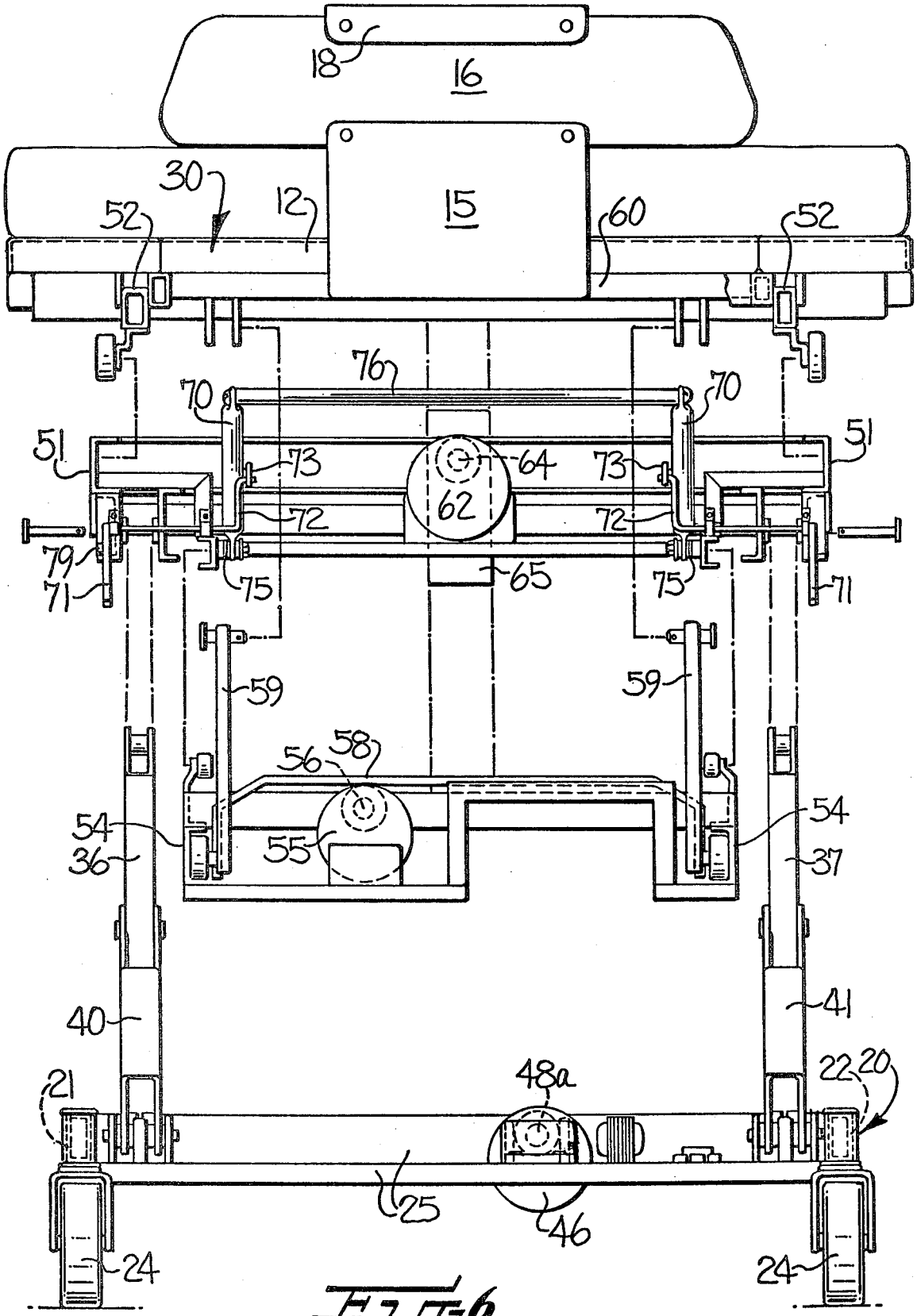
FIG. 6 is an exploded view similar to FIG. 5.
Figure 7:
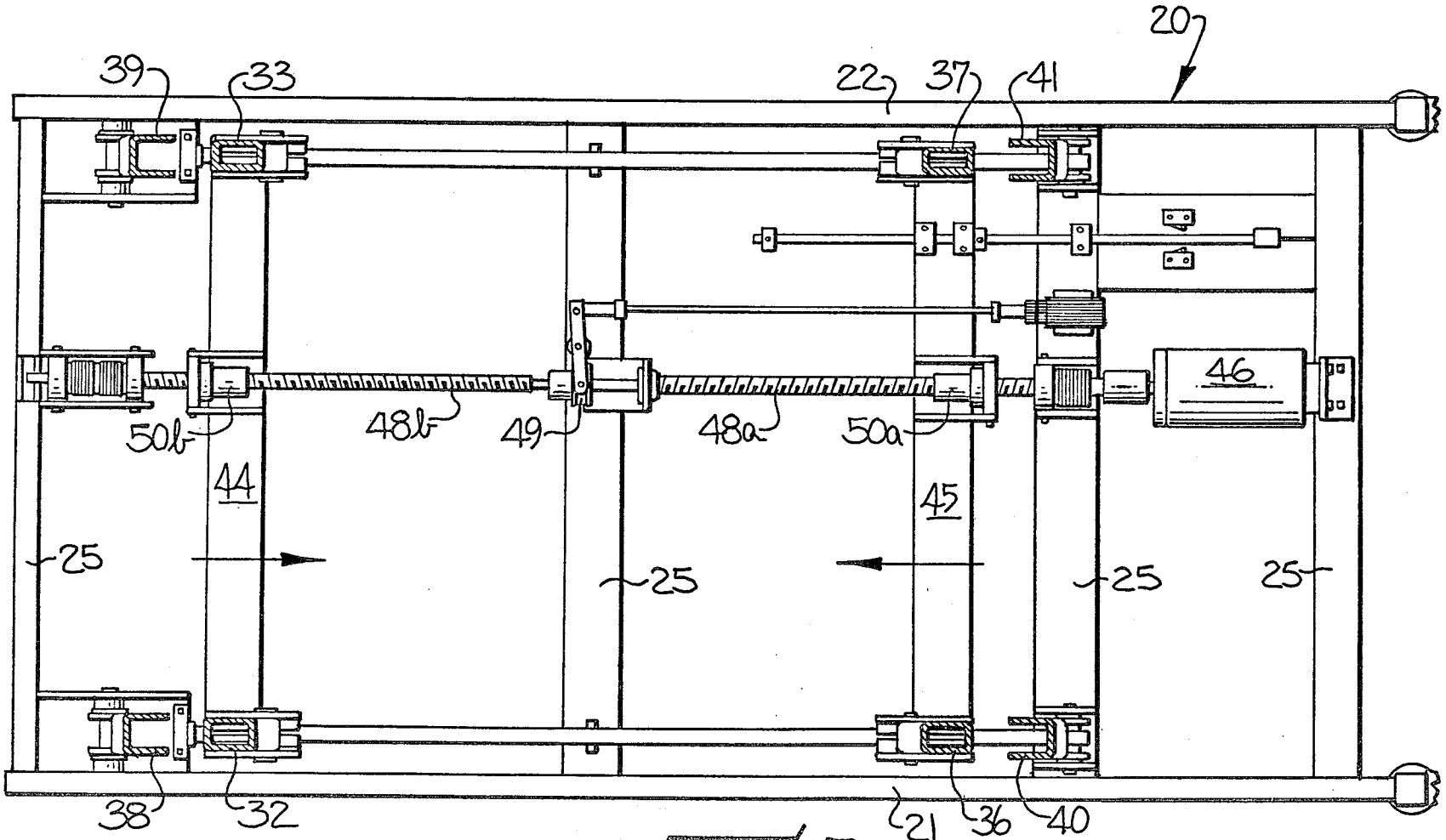
FIG. 7 is a plan, sectional view of the bed of FIG. 4.
Figure 8:
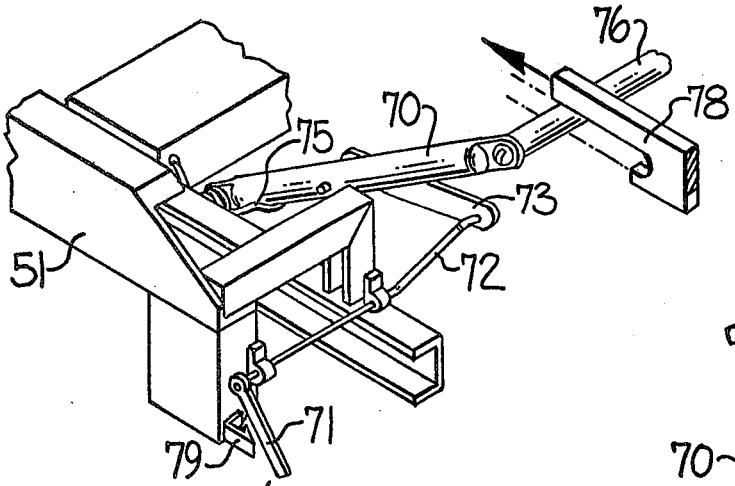
FIGS. 8–10 are schematic perspective views of elements of the bed of FIGS. 1–7, illustrating a knee break action of the bed.
Figure 9:
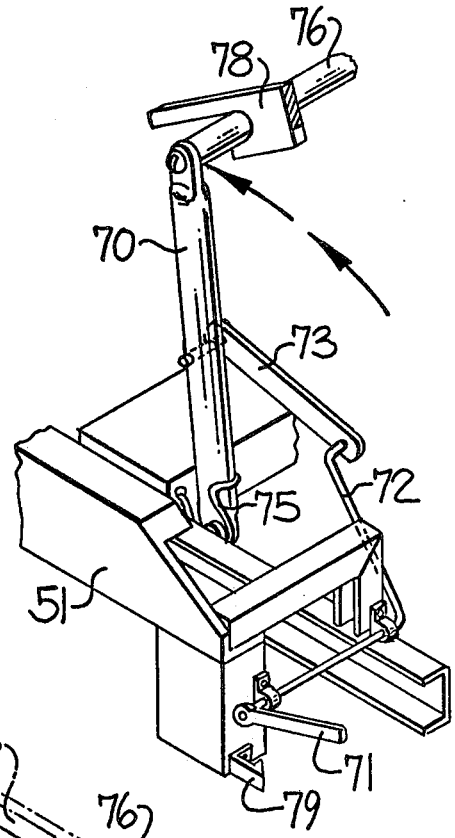
Figure 10:
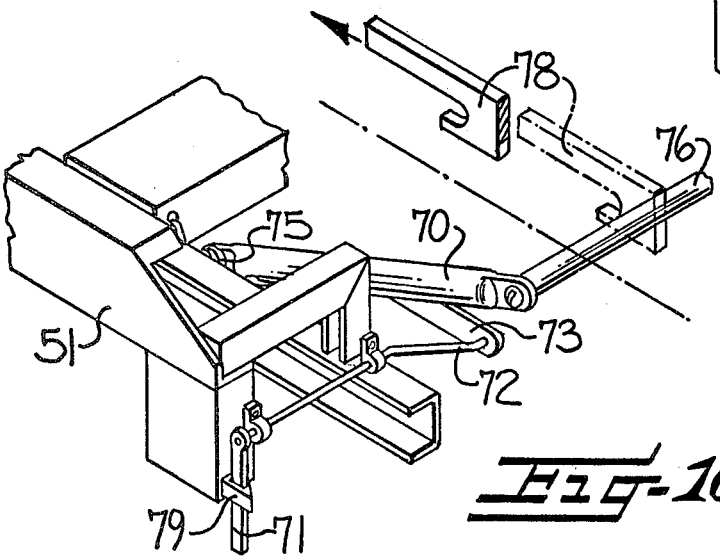
Figure 11:
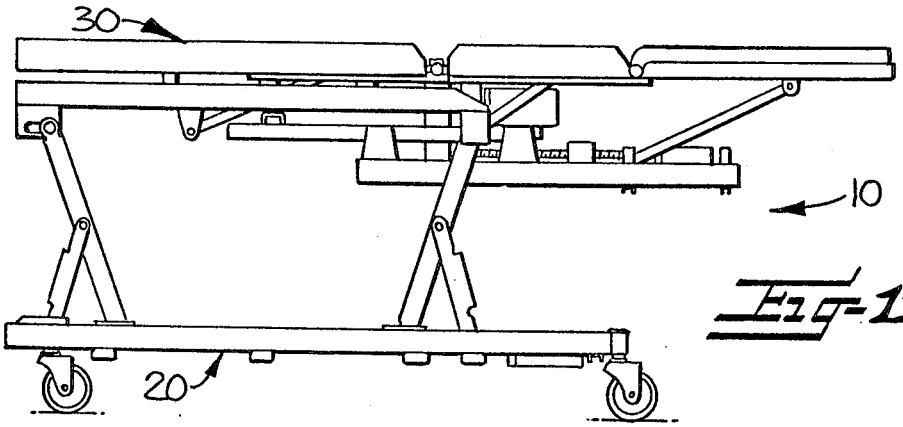
FIGS. 11–17 are side elevation views illustrating various positions attainable by the bed of the present invention.
Figure 12:
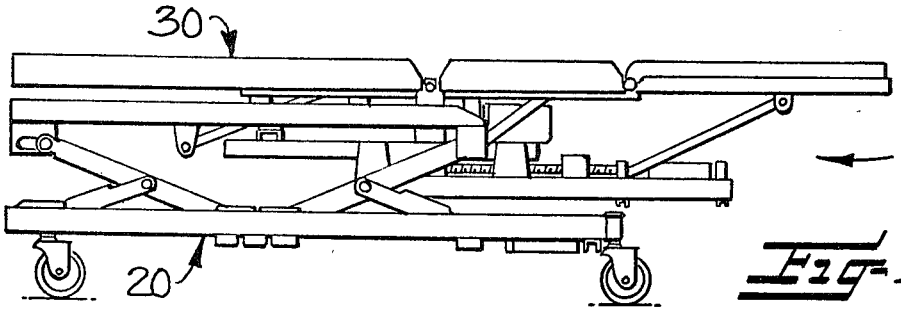
Figure 13:
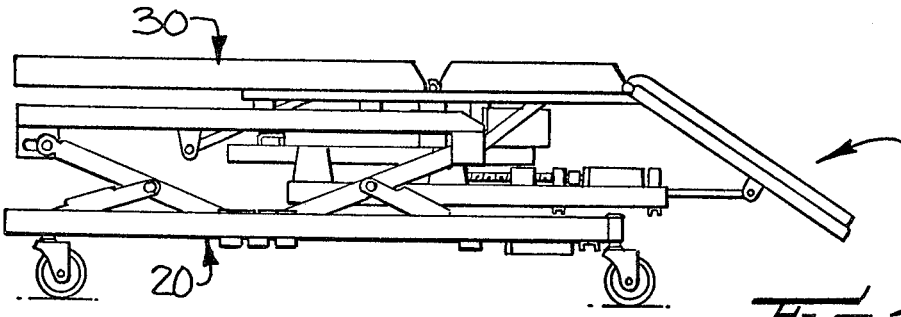
Figure 14:
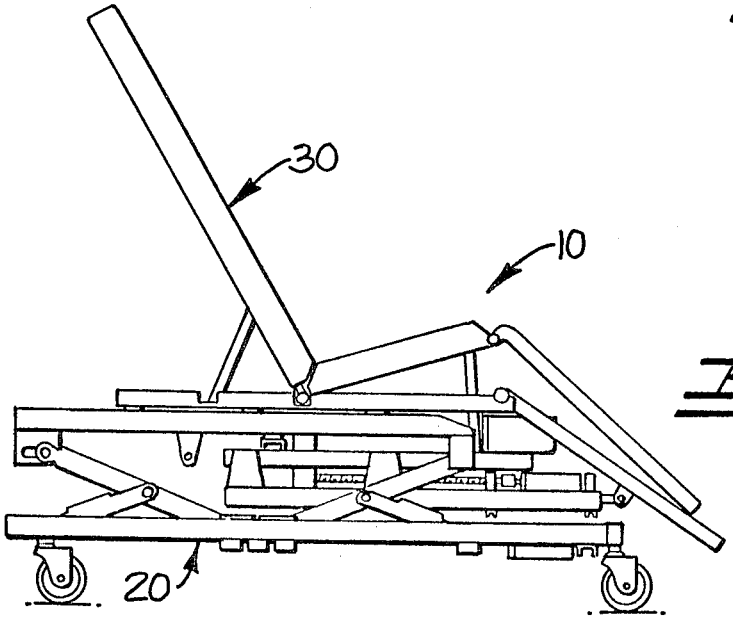
Figure 15:
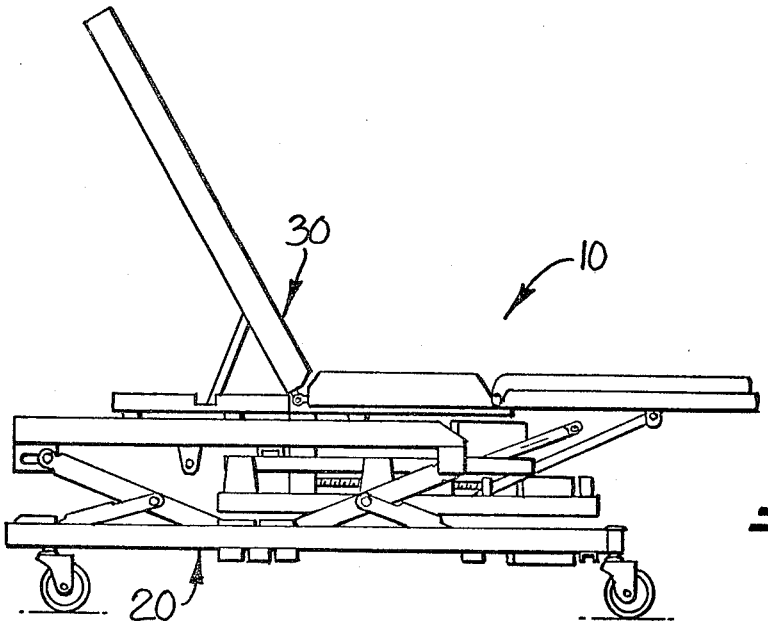
Figure 16:
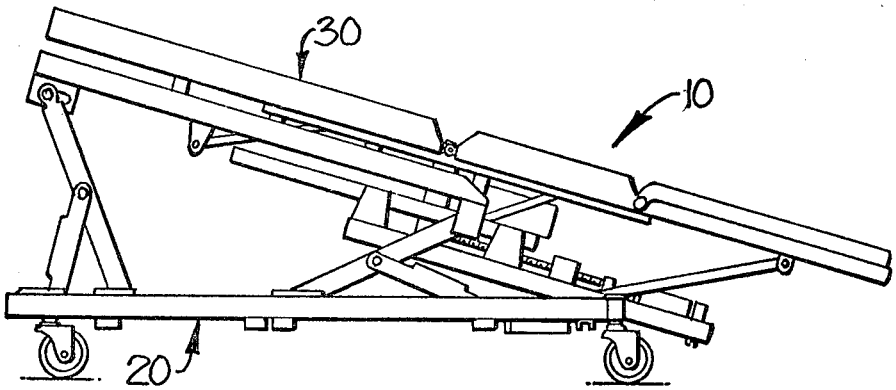
Figure 17:
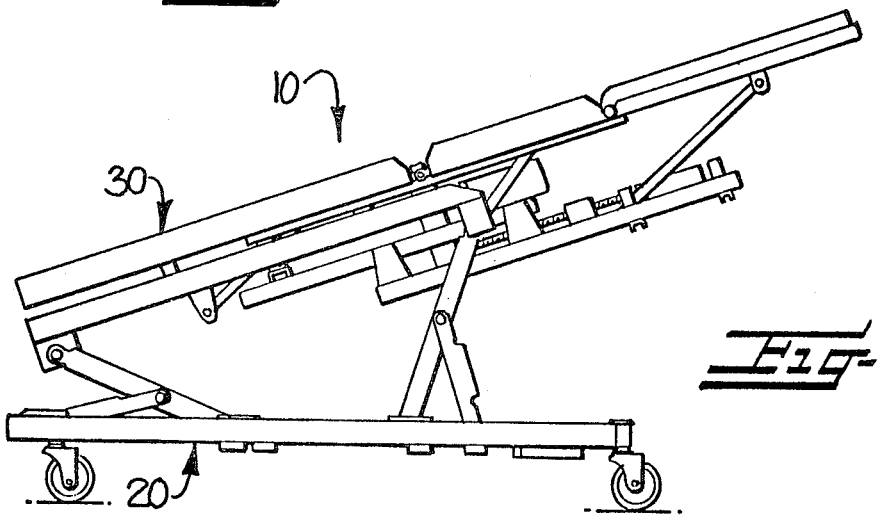

As the movements described immediately above occur and the head end portion 11 of the mattress supporting portions of the bed is moved to and from a raised or elevated position, it is possible to also change the angulation of the thigh portion 14 of the bed 10. Because it is not always comfortable to coordinate or combine head lift and thigh lift or knee break movements, change in angulation of the thigh portion 14 is optional. More particularly, a knee break arm 70 is provided and is mounted from the stationary upper frame 51. The knee break arm may be selectively biased by a spring toward an elevated position (see solid lines in FIG. 14) or may be withdrawn (FIG. 15). Particularly, and referring to FIGS. 14 and 15, a knee break control handle 71 is provided and which may, through a connecting rod 72 and link 73, move the arm 70 downward against the biasing force of a spring 75 which normally urges the arm 70 toward a raised position. The upper end of the knee break arm 70, adjacent the thigh portion 14, is connected to a coupling bar 76. The coupling bar 76 may be moved into and out of the path of movement of an actuating hook 78. More particularly, where the knee break arm 70 is moved toward the raised position by the biasing force of the spring 75, the bar 76 is positioned in the path of the hook 78 as translational movement of the thigh portion 14 occurs in response to actuation of the head lift motor 62. With such translational movement (indicated by an arrow in FIG. 14), the hook 78 engages the rod 76 and the knee break arm 70 functions as a pivoting link to elevate the foot end of the thigh portion 14 (FIGS. 5 and 14). Should it be desired that the knee break not occur, then the actuating handle 71 may be latched with a catch member 79 (FIG. 15) so as to lower the knee break arm 70 against the biasing force of the spring 75 and position the actuating rod 76 below the path of travel of the hook 78. As a consequence, with translating movement of the thigh portion 14, the hook 78 passes over and does not engage the rod 76. Absent the action of the pivoting knee break arm 70, the thigh portion 14 is maintained essentially horizontal by the moving upper frame 52.

As will be appreciated, the translation of the mattress supporting portions 11, 12, 14 and the lifting of one or both of the head portion 11 and the thigh portion 14 as described above may be combined with movement of the swing frame 60 which will control the position of the foot end portion 12. Thus, a wide range of positions are available for selection. Indeed, the interconnection of the elements described hereinabove is such that the swing frame 60 may be pivoted downwardly to an extreme position in which the foot end portion 12 of the bed 10 approaches the vertical, thereby approximating a chair position.

With the above discussion of a particular adjustable bed in mind, it can be appreciated that the improvement of the present invention is in the position controlling mechanism which operatively interconnects the mattress supporting portions and the frame and which includes the plurality of motors described above. The improved position controlling mechanism of the present invention facilitates control over movement of the bed into a variety of positions and comprises command means actuable by an operator of the bed for generating command signals indicative of selected bed positions, and means for storing control signals indicative of allowed and disallowed movements and operatively communicating with the command means and with the motors and responsive to command signals and control signals for actuating at least one of the motors for moving the frame toward an allowed, selected bed position. Specific forms of and connection among the command means and the means for storing and responding to signals will be pointed out more fully hereinafter.

In particular, the command means preferably includes, as shown, a first command signal means actuable by an occupant of the bed and heretofore referred to as the occupant control console 100, also referred to as a patient station. The command means includes a second command signal means actuable by an attendant and heretofore referred to as a nurse station control console 101. The patient station 100 may be supported on one side of the bed or may be contained within a pendant control so as to be freely accessible to an occupant of the bed 10. The patient station controls include a head portion up actuator 104, a head portion down actuator 105, a foot portion up actuator 106 and a foot portion down actuator 107. The head portion or backrest up and down actuators 104, 105 are manually actuable by a patient for generating signals for lifting and lowering the head end portion 11, through actuation of the head lift motor 62. The foot portion or foot drop up and down actuators 106, 107 are manually actuable by a patient for generating signals for lifting and lowering the foot end portion 14 by actuating the foot drop drive motor 55. As pointed out more fully hereinafter, the patient station 100 is operable only when such operation has been enabled at the nurse station 101. When the patient station 100 is operable, the head portion 11 and foot portion 14 positions may be infinitely adjustable and will be movable to any position within the range spanned. Adjustment of the head portion 11 may be accomplished in all positions of the bed except the privileged Trendelenburg and reverse Trendelenburg positions as pointed out more fully hereinafter. The position of the foot portion 14 is infinitely adjustable only when the bed 10 is in the lowered position, as pointed out more fully hereinafter.

The nurse station signal means 101 has a significantly greater capability for generating command signals than does the patient station 100 and, as pointed out more fully hereinafter, may selectively enable or disable functions of the patient station 100. More particularly, the nurse station controls include manually actuable actuators for generating signals for lifting and lowering the head end portion, indicated at 110 and 111; for enabling and disabling patient control of head end portion lifting and lowering, as respectively indicated at 112 and 113; for lifting and lowering the foot end portion as indicated at 114 and 115; for enabling and disabling patient control of foot end portion movement, as indicated at 116 and 117; for raising the bed horizontally, indicated at 118; for lowering the bed horizontally, indicated at 119; for coordinated movement of the portions of the bed into a sitting arrangement or array, indicated at 120; for coordinated movement out of the sitting array and into a horizontal, lowered position, indicated at 121; for tilting the mattress portions from horizontal array toward the drain position (indicated at 122) or toward the shock position (indicated at 124); for returning the bed from either drain or shock position to horizontal and lowered (indicated at 123 and 125); and for turning power to the bed on (indicated at 126) and off (indicated at 127).

Preferably, both the patient station signalling means 100 and the nurse station signalling means 101 are constructed as matrix arrangements of flexible conductors supported on flexible films and normally maintained in spaced relation one relative to another by a compressible media between the films. Electrical switch assemblies of the type generally described are known and have been fabricated heretofore and may, while handling relatively low voltage and current electrical signals, provide a particularly compact manner for arranging the manually actuable elements described above. Further, such matrix format switches are highly compatible with the levels of electrical voltage and current typically employed in transistor-based logic circuits of the type to be described hereinafter and employed in the improved position controlling mechanism of the present invention. As will be understood by persons of appropriate skill in the applicable arts of electronic controls, manual actuation of the indicated portions of the patient station command means 100 and the nurse station command means 101 will generate command signals indicative of the selected bed positions or functions briefly described above.

As indicated by block diagram, command signals generated by the command means are operatively communicated with a processor means which, together with a programmable memory means as described more fully hereinafter, defines a means for storing control signals indicative of allowed and disallowed movements and responding to the command signals and control signals for actuating the motors for moving the frame of the bed toward an allowed, selected bed position.

In operating embodiments of beds in accordance with the present invention, the programmable memory means contemplated by the present invention takes the form of an erasable, programmable read only memory device or EPROM. Such devices and their use in conjunction with a processor means are well known to persons of ordinary skill in the arts of electronic controls and, accordingly, need not be here described at great length. The processor means incorporated in the position controlling mechanism of the present invention, in one operating embodiment constructed, takes the form of an 8085 microprocessor. Data sheets and information concerning such microprocessors are readily available to persons of ordinary skill in the arts of electronic controls and will enable such persons, when taken together with the functional descriptions contained in the present specification, to use such a processor means in the manner here described.

By means of appropriate conductors, the processor means, generally indicated at 140, operatively communicates with the command means in the form of the patient station 100 and the nurse station 101. Additionally, the processor 140 similarly communicates with the programmable memory means or EPROM 141 and with each of the motors 46, 55, 62. Communication with the motors is preferably established through conventional semiconductor circuits of a type known as drivers and typically including bidirectional semiconductor switches or triacs. Additionally, the processor means 140 communicates with a clutch control solenoid 144 which governs engagement and disengagement of the clutch 49 described above and with limit switches which function as position signal means actuable by elements of the bed for generating position signals indicative of movements of elements of the bed to predetermined positions. More specifically, a pair of drain and shock limit switches 145, 146 signal movement of the lifting arms which achieve maximum permissible Trendelenburg and reverse Trendelenburg tilts on the order of approximately 13 degrees from the horizontal. Additionally, each of the motors 46, 55, 62 includes an internal position signalling switch actuable in response to rotation of the motor shaft and thus of the corresponding screw for signalling such rotation. Persons skilled in the design of electronic controls will be able to understand, from these brief descriptions, the manner of using such position signalling means and will be able to contemplate other types of movement of elements of the bed which it may, in certain circumstances, be desirable to signal.

Operation of the processor 140 preferably proceeds in accordance with a program or control signals stored in the programmable memory means 141 and as timed by an oscillator or clock. The normal program state of the processor is one of essentially waiting, subject to an interrupt responsive to the generation of a command signal. The command signal may be one which directly establishes a preferred status for the adjustable bed and is referred to as a machine state. By way of example, should a nurse manually actuate the patient disable control 113 so as to prevent patient actuation of the head lift, such a command signal would be received by the processor and transmitted to the programmable memory for storage as a control signal indicative of a disallowed movement of the bed. The disallowed movement would be a patient-controlled head portion lifting or head portion lowering movement. The machine state control signals may be modified, for example, by the nurse actuating the patient enable control 112 so as to permit an occupant of the bed to have control over the head portion lifting and lowering functions. The drain position and shock positions, reached by nurse actuation of the respective controls 122, 124, are privileged positions in that movement of the adjustable bed to such positions results in the processor entering into the programmable memory control signals indicative that the only allowed movement will be a return from the respective one of the drain or shock positions, with all other movements being disallowed.

As will be understood, interruption of the waiting state of the processor means by a command signal will result in the processor, following an established program, reviewing the machine state to determine whether or not the indicated selected bed position is a movement allowed by the machine state. Additionally, with respect to all functions other than lowering of the bed to down flat, as requested by nurse actuation of the corresponding control 119, results in a cyclical review of the continued presence of the command signal. That is, with a command signal such as a signal for lifting the head portion of the bed, the processor means reviews the continued generation of the command signal on a periodic basis such as approximately once every thirty milliseconds. For so long as the corresponding command signal is generated, the processor means continues to signal for actuation of the corresponding motor, until such time as either the command signal is discontinued (due to the patient or nurse being satisfied by the position in which the bed has been moved) or the associated position signal means such as the limit switches generate a position signal indicative of movement of the portion of the bed to a predetermined limiting position. Should the moving portion of the bed, such as the head portion 11, have available a range of movement toward the allowed, selected bed position, then the processor means will respond to the position signal from the corresponding limit switch by actuating the corresponding motor so as to permit moving the frame of the bed toward the allowed, selected bed position. Should the corresponding limit switch indicate, by signal state, that the limiting position has been reached, then the processor means will interrupt such movement of the bed portion.

In order to facilitate access to a patient or occupant of the bed in the event of an emergency situation, selected command signals may be given a preferred status and excluded from the cyclic review of a continuance of generation of command signal. By way of specific example, the programmable memory means may receive and store a control signal indicative that the nurse actuated down flat control 119 be given priority. In such an instance, the processor means will respond to momentary generation of the corresponding command signal by beginning movement of the bed toward the horizontal array, lowered position and continue such movement until that position is attained, without requiring that generation of the corresponding command signal be continued during such time as such movement occurs. Thus, should an attendant to the occupant of the bed require access to the occupant, it is not necessary that the attendant remain by the footboard and maintain manual actuation of the corresponding nurse station control element 119.

As will be appreciated, the cooperation of the programmable memory means and the processor means additionally provides such sequencing features as precluding movement of the bed toward the sitting position (as upon a nurse actuating the sitting position control 120) until such time as some necessary preliminary movement has been made. By way of example and referring to the sitting position, an operating embodiment of the bed in accordance with the present invention cannot be moved to the sitting position until such time as the bed has first been moved to the horizontal array, fully lowered position. When moved through such a sequence, an adjustable bed in accordance with the present invention may assume a configuration generally similar to that of a chair.

As will be understood by persons of appropriate skill in the electronic control arts, the combination and cooperation of the command means actuable by an operator of the bed and the means for storing control signals and responding to command and control signals introduces great flexibility into the position controlling mechanism of a bed constructed and operated in accordance with the present invention. A number of illustrations have here been given, in very brief form, of the types of operations available in an adjustable bed of the type described. Many more combinations and interactions are available and will be accomplished by persons skilled in the applicable arts as the invention described above is applied to varying environments in which adjustable beds are used.

In the drawings and specification there have been set forth preferred embodiments of this invention, and although specific terms are employed, they are used in a generic and descriptive sense only and not for purposes of limitation, the scope of the invention being defined in the claims.

That which is claimed is:

1. In a motor driven adjustable bed having mattress supporting portions for supporting a mattress for an occupant in a variety of positions and including a head portion at a head end of the bed, a foot portion at a foot end of the bed, and a thigh portion between the head and foot portions, frame means for supporting the mattress supporting portions, and position controlling mechanism operatively interconnecting the mattress supporting portions and the frame means and including a plurality of motors operatively connected with the frame means for moving the frame means and thereby for positioning the mattress supporting portions in desired positions, an improvement in said position controlling mechanism which facilitates control over movement of the bed into a variety of positions and comprising:

command means actuable by an operator of said bed for generating command signals indicative of selected bed positions, and means for storing control signals indicative of allowed and disallowed movements and operatively communicating with said command means and with said motors and responsive to said command signals and to said control signals for actuating at least one of said motors for moving said frame means toward an allowed, selected bed position.

2. In a motor driven adjustable bed having mattress supporting portions for supporting a mattress for an occupant in a variety of positions and including a head portion at a head end of the bed, a foot portion at a foot end of the bed, and a thigh portion between the head and foot portions, frame means for supporting the mattress supporting portions, and position controlling mechanism operatively interconnecting the mattress supporting portions and the frame means and including a plurality of motors operatively connected with the frame means for moving the frame means and thereby for positioning the mattress supporting portions in desired positions, an improvement in said position controlling mechanism which facilitates control over movement of the bed into a variety of positions and comprising:

command means actuable by an operator of said bed for generating command signals indicative of selected bed positions, programmable memory means for receiving and storing control signals indicative of allowed and disallowed movements, and processor means operatively communicating with said command means and with said programmable memory means and with said motors and responsive to said command signals and to said control signals for actuating at least one of said motors for moving said frame means toward an allowed, selected bed position.

3. An adjustable bed according to claim 2 wherein said command means comprises first signal means actuable by an occupant of the bed and second signal means actuable by an attendant and further wherein said processor means distinguishes between command signals originating from said first and second signal means, said second signal means and said processor means cooperating for selectively precluding actuation of any of said motors in response to command signals generated by said first signal means.

4. An adjustable bed according to one of claim 2 or claim 3 wherein said position controlling mechanism further comprises position signal means actuable by elements of said bed for generating position signals indicative of movement of elements of the bed to predetermined positions, and further wherein said processor means operatively communicates with said position signal means and is responsive to said position signals for actuating at least one of said motors for moving said frame means toward an allowed, selected bed position.

5. An adjustable bed according to one of claim 2 or claim 3 wherein said processor means and said programmable memory means cooperate for distinguishing among command signals generated by said command means and for actuating motors for moving said frame means toward at least one allowed, selected bed position in response to momentary generation of a corresponding command signal.

6. An adjustable bed according to one of claim 2 or claim 3 wherein said processor means and said programmable memory means cooperate for distinguishing among command signals generated by said command means and for actuating motors for moving said frame means toward at least one allowed, selected bed position only during continuance of generation of a corresponding command signal.

7. In a motor driven adjustable bed having mattress supporting portions for supporting a mattress for an occupant in a variety of positions and including a head portion at a head end of the bed, a foot portion at a foot end of the bed, and a thigh portion between the head and foot portions, frame means for supporting the mattress supporting portions, and position controlling mechanism operatively interconnecting the mattress supporting portions and the frame means and including a plurality of motors operatively connected with the frame means for moving the frame means and thereby for positioning the mattress supporting portions in desired positions, an improvement in said position controlling mechanism which facilitates control over movement of the bed into a variety of positions and comprising:

first command signal means actuable by an occupant of the bed for generating command signals indicative of selected bed positions, second command signal means actuable by an attendant for generating command signals indicative of selected bed positions, position signal means actuable by elements of the bed for generating position signals indicative of movement of elements of the bed to predetermined positions, programmable memory means for storing control signals indicative of allowed and disallowed movements of the bed, and processor means operatively communicating with said signal means and with said memory means and with said motors and responsive to said signals for actuating at least one of said motors for moving said frame means toward an allowed, selected bed position, said processor means distinguishing among command signals generated by said first and second command signal means for actuating motors for moving said frame means toward a horizontal, lowered position in response to momentary generation of a corresponding command signal by said second command signal means.

8. In a motor driven adjustable bed having mattress supporting portions for supporting a mattress for an occupant in a variety of positions and including a head portion at a head end of the bed, a foot portion at a foot end of the bed, and a thigh portion between the head and foot portions, frame means for supporting the mattress supporting portions, and position controlling mechanism operatively interconnecting the mattress supporting portions and the frame means and including a plurality of motors operatively connected with the frame means for moving the frame means and thereby for positioning the mattress supporting portions in desired positions, an improvement in said position controlling mechanism which facilitates control over movement of the bed into a variety of positions and comprising:

first command signal means actuable by an occupant of the bed for generating command signals indicative of selected bed positions, second command signal means actuable by an attendant for generating command signals indicative of selected bed positions, position signal means actuable by elements of the bed for generating position signals indicative of movement of elements of the bed to predetermined positions, programmable memory means for storing control signals indicative of allowed and disallowed movements of the bed, and processor means operatively communicating with said signal means and with said memory means and with said motors and responsive to said signals for actuating at least one of said motors for moving said frame means toward an allowed, selected bed position, said processor means distinguishing among command signals generated by said first and second command signal means for actuating motors for moving said frame means toward at least one allowed selected bed position only during continuance of generation of a corresponding command signal by said command signal means.

9. An adjustable bed according to one of claim 7 or claim 8 wherein said first command signal means is normally actuable for generating signals for lifting and lowering the head end position and for lifting and lowering the foot end position, and further wherein said second command signal means is manually actuable for generating signals for lifting and lowering the head end portion and for lifting and lowering the foot end portion and for raising and lowering the mattress portion while in horizontal array and for tilting the mattress portion from horizontal array toward drain and toward shock positions and for coordinated movement into and out of a sitting array, and further wherein said processor means and said second command signal means cooperate for selectively precluding actuating of any of said motors in response to command signals generated by said first command signal means.

10. A method of controlling the operation of a motor driven adjustable bed which has a plurality of motors operatively connected with a frame for moving the frame and thereby for positioning a head portion, a foot portion, and a thigh portion in desired positions, the method comprising the steps of storing in a programmable memory, control signals indicative of allowed and disallowed movements for the bed, generating command signals indicative of selected bed positions, and responding to the command signals and to the control signals by actuating at least one of the motors for removing the frame toward an allowed, selected bed position.

11. A method according to claim 10 wherein the step of responding to command signals and to control signals comprises communicating generated command signals to a processor, retrieving with the processor control signals stored in the programmable memory, and distinguishing from the command and control signals the selection of an allowed bed position.

12. A method according to one of claims 10 and 11 wherein the step of generating command signals comprises generating a first set of command signals in response to actuation of command signal switches by an occupant of the bed, and generating a second set of command signals in response to actuation of switches by an attendant and further wherein the step of responding to command signals and to control signals comprises distinguishing between command signals of the first set and command signals of the second set while directing by certain command signals of the second set that actuation of any of the motors in response to command signals of the first set be selectively precluded.

13. A method according to one of claims 10 and 11 further comprising generating position signals indicative of movement of elements of the bed to predetermined positions, and further wherein the step of responding to command signals and to control signals includes responding to position signals for actuating at least one of the motors for moving the frame toward an allowed, selected bed position.

14. A method of operating a bed in accordance with one of claims 10 and 11 wherein the step of responding to command signals and to control signals comprises distinguishing among command signals and actuating motors for moving of the frame toward at least one allowed, selected bed position in response to momentary generation of a corresponding command signal.

15. A method of operating a bed in accordance with one of claims 10 and 11 wherein the step of responding to command signals and to control signals comprises distinguishing among command signals and actuating motors for moving of the frame toward at least one allowed, selected bed position in response to momentary generation of a corresponding command signal.

* * * * *